United States Patent [19]

Santucci et al.

[11] 4,071,054

[45] Jan. 31, 1978

[54] DEVICE FOR DISPLACING THE WEFT-CARRIERS IN A MULTISHED LOOM

[75] Inventors: Nicola Santucci, Schio (Vicenza), Italy; Zabotin Aleksandr Aleksandrovic; Loschilin Evghenii Dmitrievich; Galperin Aleksandr Lvovich; Onikov Eduard Archakovich; Sakharov Boris Aleksandrovich; Borodin Valerian Alekseevich, all of Moscow, U.S.S.R.

[73] Assignees: Nuovo Pignone S.p.A., Italy; ANIKHBI: Tsentralny Nauchne-issledevatelsky institut khlopehatobumiezhnoi promyshlinnesti, U.S.S.R.

[21] Appl. No.: 728,240

[22] Filed: Sept. 30, 1976

[30] Foreign Application Priority Data

Oct. 3, 1975 Italy ..... 27955/75

[51] Int. Cl.[2] ..... D03D 47/26

[52] U.S. Cl. ..... 139/436; 198/852

[58] Field of Search ..... 139/436–439; 198/851–853

[56] References Cited

U.S. PATENT DOCUMENTS

| | | | |
|---|---|---|---|
| 3,729,029 | 4/1973 | Zabrodsky et al. | 139/436 |
| 3,744,618 | 7/1973 | Monne et al. | 198/852 X |
| 3,765,458 | 10/1973 | Ziegler et al. | 139/439 |
| 3,908,706 | 9/1975 | Onikov et al. | 139/436 |
| 3,934,619 | 1/1976 | Loschilin et al. | 139/436 |

*Primary Examiner*—James Kee Chi

*Attorney, Agent, or Firm*—Morgan, Finnegan, Pine, Foley & Lee

[57] ABSTRACT

A device for displacing the weft-carriers in a weaving loom which comprises an endless chain composed of discrete links, one of the links having a space in which a carriage with a carrier roller is arranged. The links are universally connected to one another so that they can be displaced on planes which are perpendicular to each other.

9 Claims, 7 Drawing Figures

DEVICE FOR DISPLACING THE WEFT-CARRIERS IN A MULTISHED LOOM

This invention relates to textile looms, and more particularly to devices for displacing the weft-carriers in the shed of such looms.

A device is known for the displacement of the weft-carriers. In this device, an endless chain, includes individual links wherein, carriages are at even intervals which are equipped with rollers which coact with the shuttle rollers, and with vertical pins which are slidable relative to the chain. With the aid of a lever, as guided by a cam, the vertical pins with the shuttles as they emerge from the shed and leave the shuttles as they enter the shed.

In this device, as the shuttle enters the warp, the rollers arranged in the shuttles and on the link of the endless chain enter into contact and, as they meet the warp, may cause breakages due to their action.

In another known device, the shuttles, have the shape of bobbins are provided with a conical space in their axis. These shuttles are displaced outside the shed with the aid of an endless extensible ribbon, having conical pins which are evenly spaced apart and are intended to contact the conical hollow space of the shuttle. In the shed, the shuttle is moved by magnets arranged on the ribbon. Before the shuttle enters the shed, there is a length along which it is simultaneously displaced by the action of both the pin and the magnet. A defect of this device is that the magnets are incapable of ensuring an accurate displacement of the shuttle.

In still another known device for displacing the weft-carriers in the shed of a loom capable of weaving plural fabric lengths, the device having an endless-chain conveyor, comprising two types of links. The links of one type are connecting links, whereas the links of the other type carry two kinds of members, the first of which is so designed as to become connected with the weft carrier for conveying the same outside the shed, and the other member has the configuration of a plurality of rollers which, by the intermediary of a ribbon arranged in the weaving field, act upon the rollers of the weft carriers (shuttles) to displace the latter into the shed. The endless chain is continuously displaced on a plane, whereas the elements with which the carrier link is equipped for the displacement of the shuttle are moved on a vertical plane.

In one embodiments of the device, the member which displaces the shuttle outside the shed has a sloping position which enables the clearance between the shuttle roller and the roller arranged on the carrier link to be achieved when both rollers enter action with the cover ribbon. In any case, this embodiment cannot provide a sufficiently wide clearance between the rollers and requires the presence of the cover ribbon in the weaving field, or it requires, for displacing the shuttle in the shed, the presence of the roller which modifies its position on the vertical plane.

In another embodiment of the patent hinted at above, the members intended for the displacement of the shuttle in the shed and outside the shed make an intricate movement.

In both embodiments, the carrier link has an intricate structure and requires the presence of the cover ribbon in the weaving field.

An object of this invention is overcome the described drawbacks of the known device. The main object of the invention is to provide a device for displacing the weft carriers in the shed of a multi-fabric loom, in which the means for guiding the shuttles has a simplified structure which ensures a reliable grasp of the shuttles during their displacement and an adequate clearance between each shuttle roller and the roller arranged on the endless conveyor, as they enter the weaving field.

The objects of the invention are accomplished by providing a device for displacing the shuttle in the shed of a multished loom, in which there is an endless chain which consists of discrete links. One of the links has a space in which a carriage, having a carrier roller, is arranged. All of the links are connected together by spherical joints which enable the links to be displaced one relative to the other on mutually perpendicular planes. The chain is displaced on fixed ways which have two rectilinear and two curvilinear sections: on either curvilinear section the chain is in mesh with a rotary disc which ensures the displacement of the chain on the plane of rotation of the disc. On the fixed guide for the chain, along the entire length of the latter, there are guiding members which mesh with the links of the chain and the carriage of the carrier roller and which define the position of these on the vertical plane. In the weaving area the guiding members for the chain change their position on the vertical plane, and consequently the links of the chain at the inlet to the weaving area are depressed, by being rotated with respect to the next link and, in the depressed position, they enter the weaving area and are restored to the previous level in the end portion of the weaving area, by being similarly rotated on the vertical plane. The hinge which connects the link carrying the guiding roller with the next link is provided with a pin (pivot), with a free end, which lies in the hollow space of the shuttle when the link is in its lifted position and emerges from the cavity of the shuttle when it is in its depressed position. The rotation of the chain link on the vertical plane causes the rotation of the pin (pivot) with the free end, which pin imparts to the shuttle an additional displacement during progress of the movement, the clearance between the rollers being increased, after the emersion of the pin from the hollow space of the shuttle when the contact between the rollers takes place. When the pin with the free end enters the hollow space of the shuttle, the pin itself, by being rotated, displaces the shuttle during progress of the movement and restores the clearance between the rollers. In the fixed guide there are channels which define the position of the carriage with the carrier roller. The channels have a constant level on the vertical plane along the entire length of the fixed guides and thus, when the chain link is lowered into the weaving area, the level of the carrier roller remains unaltered.

In the following, an exemplary embodiment of the invention is described with reference to the accompanying drawings, wherein.

Figure 6B:
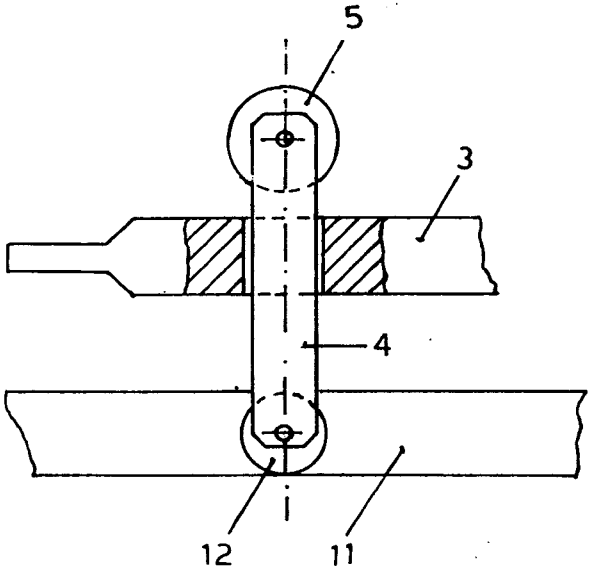
Figure 6A:
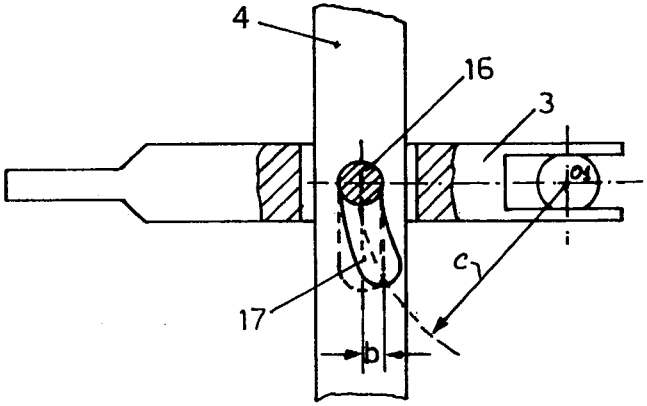

FIGS. 6*a* and 6*b* show modifications for connection of the chain links and the carriage of the carrier roller.

Figure 1:
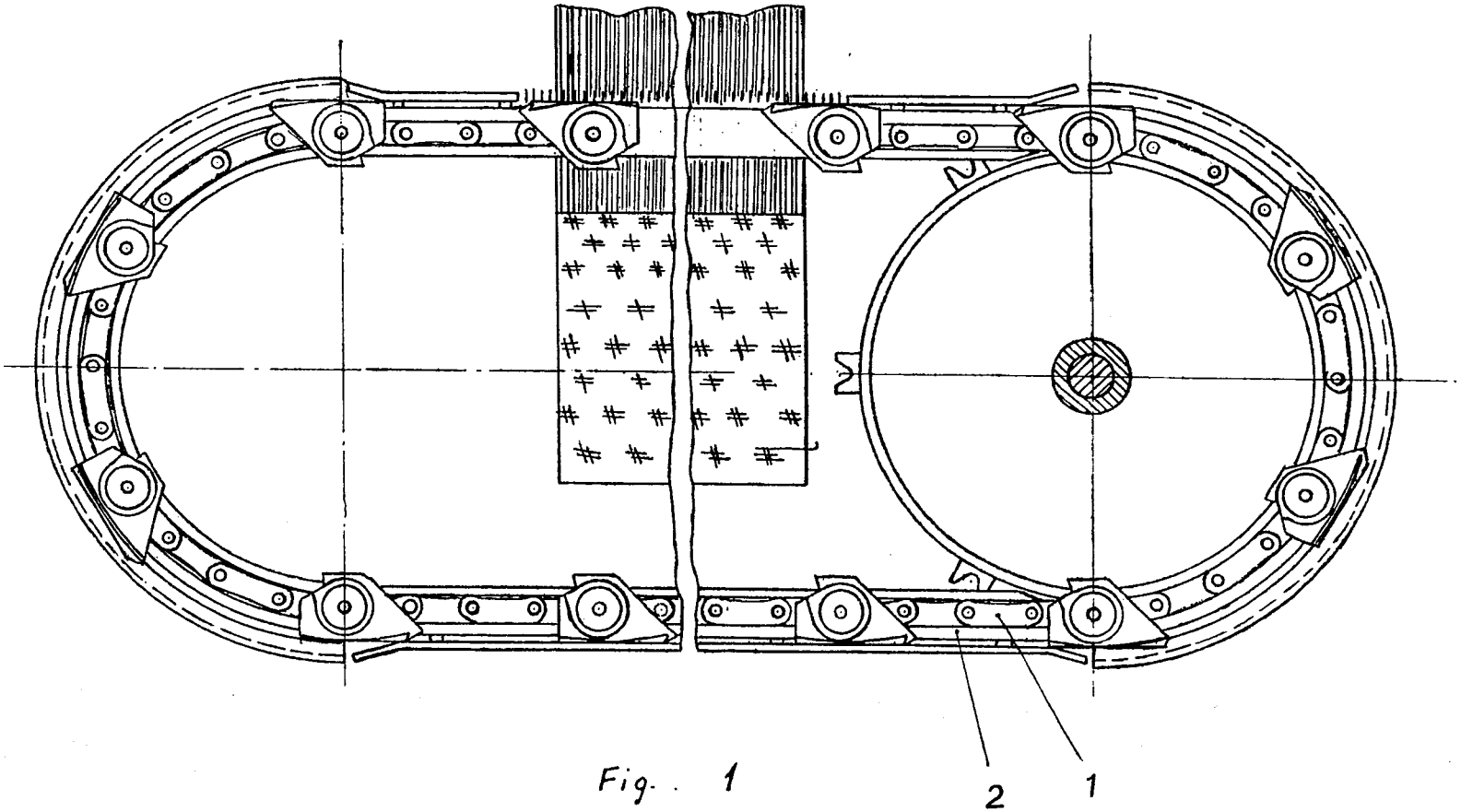
FIG. 1 shows an overall view of the device for the displacement of the shuttles.

Referring to FIG. 1, the device for displacing the shuttles comprises an endless chain 1 and a fixed guide 2 in which the chain conveyor is arranged.

Figure 2:
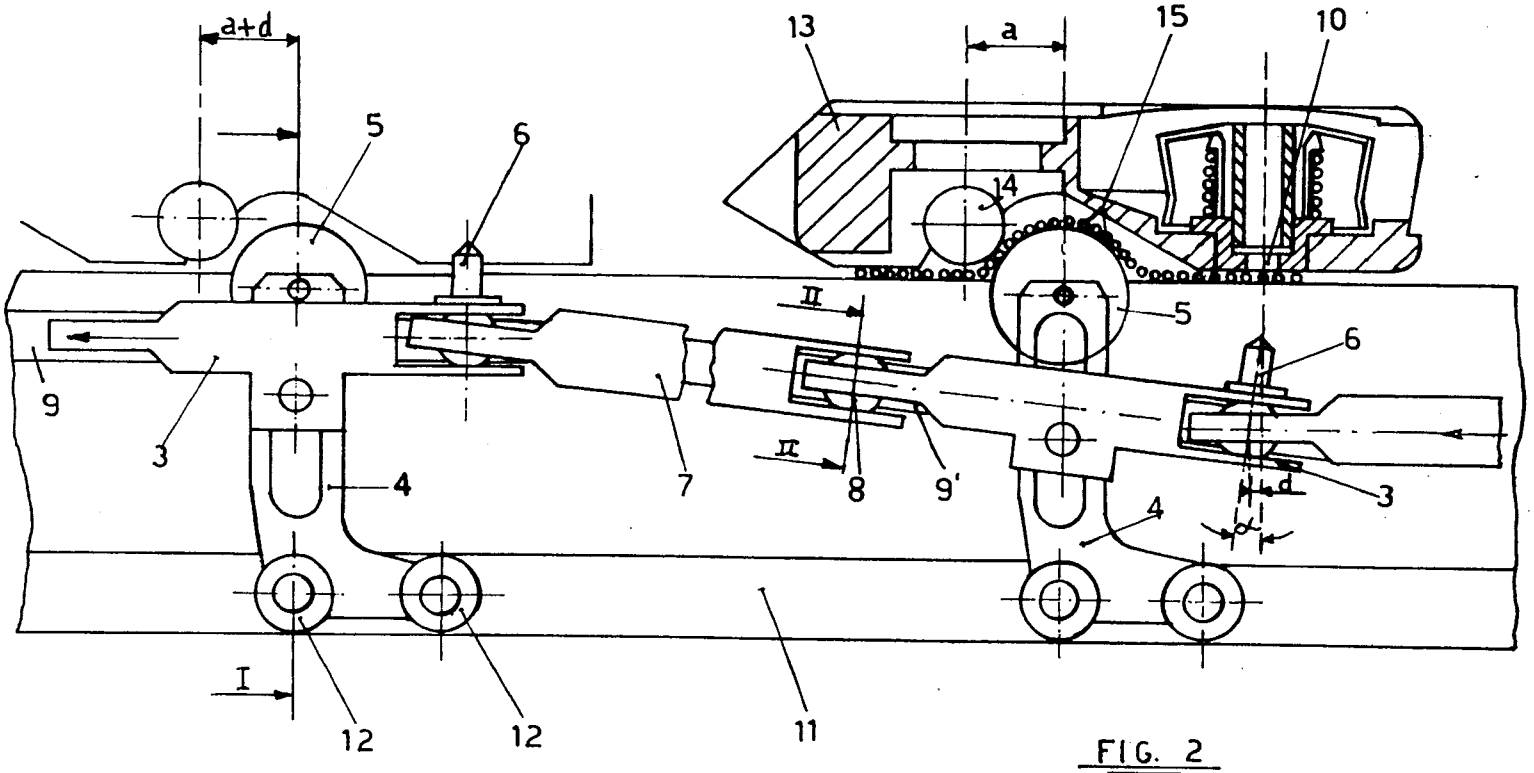
FIG. 2 is a view of the endless chain conveyor.

As shown in FIG. 2 the chain is made up of links. Some of these links which bear the reference numberal 3 are carrier links in that they are connected in a movable manner to carriages 4. In turn, each carriage 4 carries a guiding roller 5. Fixed to each link 3 is a pin 6, which, as shown, has a conical end. The other links, which bear the reference numeral 7 and which are between the links 3, are connection members. The number of links 7 depends on their size and the pitch between the shuttles 13. All the links 3 and 7 are connected to one another by the spherical hinges or joints 8.

Figure 5:
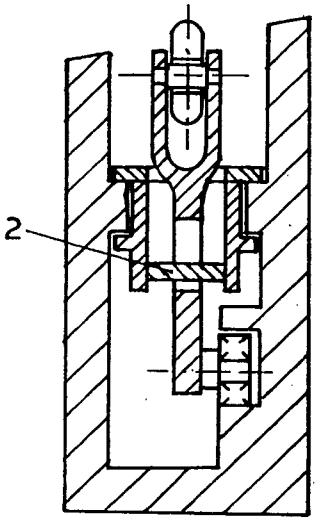
FIG. 5 shows the position of the chain in the weaving area.
Figure 4:
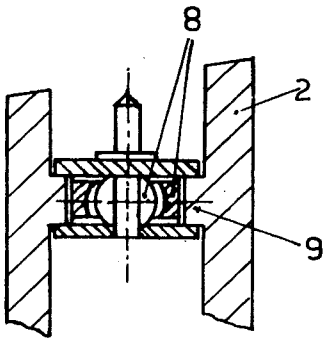
FIG. 4 is a cross-sectional view taken along the line II—II of FIG. 2.
Figure 3:
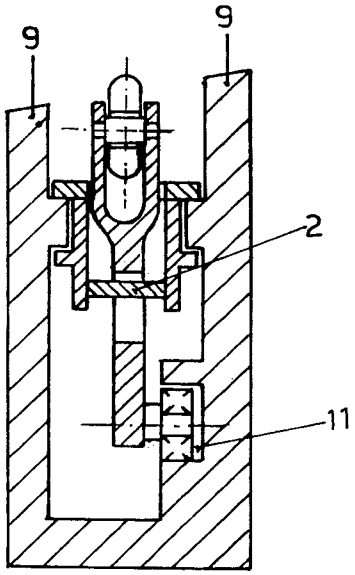
FIG. 3 is a cross-sectional view taken along the line I—I of FIG. 2.

The entire internal surface of the guide 2 there are projections 9, which define the position and level of the chain 1 (See FIGS. 3 and 5). In the weaving area shown in FIG. 1, the projections 9 are at a lower level. Outside the weaving area the projections 9 are at a higher level. The lifted position of the projections 9 ensures the coupling of the pin 6 with the hole of the shuttle 10. The lowered position of the projections 9 allows the pins 6 to pass beneath the warp. The lowered portion of the projections 9 is connected with the raised one by means of the inclines 9', shown in FIG. 2, which ensure the depressional movement with a translational motion and also the rotation of the chain links.

The guide 2 has, along its entire length, the groove 11 which is at a constant level. The rollers 12 of the carriage 4 are arranged in the groove 11 to ensure the desired position for the carriage 4 as well as the constant level for the roller 5.

The displacement of the shuttle 13 into the shed is obtained by the pressure force of the guiding roller 5 on the roller 14 of the shuttle 13 through the warp threads 15. The hole 10 in the shuttle 13 is located above the free end of the pin 6 which is inclined by an angle alpha, since the chain link is also inclined by the same angle, alpha, in that it is located on the passageway of the projections 9. During progress of the displacement of the chain in the guide, the link 3 which carries the pin 6 is displaced along the inclined projection 9' and is simultaneously approached to the shuttle 13 so that it ensures the entrance of the end of the pin 6 in the hole 10. In this instant of time the initial portion of the link 3 enters the horizontal portion of the projections 9, the link 3 begins to be rotated (in FIG. 2 in the anticlockwise direction) and simultaneously the pin 6 begins its rotation. The pin 6, by this movement, enters the hole 10 and displaces the shuttles 13 by a distance which is sufficient to provide a preliminary gap between the rollers 5 and 14.

Before the shuttle 13 enters the shed, the link 3, by being lowered, is rotated and causes the pin 6 to be similarly rotated, the pin 6 emerging in this instant of time from the hole 10. As the pin 6 is rotated, during pogress of its movement, it properly displaces the shuttle 13 and provides the desired space between the rollers 5 and 14 as they enter between the warp threads.

In FIG. 2 the distance designated "*a*" indicates the distance between the axes of the rollers 5 and 14 in the direction of movement of the shuttle 13, and "*d*" indicates the additional distance between such axes caused by the rotation of the pin 6 in the shuttle 13 through the angle "alpha".

The connection of the carriage 4 with the guiding roller can be variously embodied. In one embodiment (FIG. 6*a*) the link 3 by being depressed, is rotated about the axis $O_1$. The connection of the carriage 4 with the link 3 can be made with the cooperation of the pin 16 which is rigidly fastened to the link 3 and the through-groove 17 in the body of the carriage 4. The carriage 4 has two rollers 12, arranged along the axis of the groove 11. In this case, in correlation with the arrangement and the configuration of the groove, the pin 16, by being depressed, along the groove 17, can displace the carriage along the longitudinal axis of the link. For example, with the provision of the groove according to the radius C of the point $O_1$, the carriage does not change its position along the longitudinal axis of the link 3. If the groove 17 is rectilinear along the vertical axis of the carriage 4, the carriage will be displaced in the groove "*b*" but in any case the carriage 4 will not be rotated in the plane represented by the sheet for the drawing.

In another embodiment (FIG. 6*b*) the carriage 4 has a single roller 12, and the connection of the link 3 with the carriage 4 does not permit that a change in the angle between the carriage 4 and the link 3. By so doing, when the link 3 is rotated through an angle alpha, the carriage 4 also will be rotated through the angle alpha and the roller 12 will change its position relative to the shuttle 13.

What I claim is:

1. A device for driving shuttles of a weaving loom, comprising an endless chain made up of links interconnected by hinges and including a plurality of carrier links and carriages, wherein each of said carrier links is connected to one of said carriages for driving its carriage around a path in the form of a closed loop, each of said carriages having a drive member for moving a shuttle of the loom, each carrier link having a pin for engagement with a hole in a shuttle, the engagement between each carriage and its carrier link being such as to allow relative movement between said carriage and the said carrier link in a direction transverse to the intended direction of movement of of the carriage, chain guide means and carriage guide means for guiding said chain and each carriage, wherein when said chain is driven, each carrier link is guided by said chain guide means into and out of an engagement position in which the said pin of said carrier link is presented for engagement with the hole of the shuttle and during such movement is pivoted to cause the shuttle, when engaged by said pin, to be advanced relatively to the drive member of said carriage.

2. A device for driving shuttles according to claim 1, in which said hinges which interconnect said links are spherical joints.

3. A device for driving shuttles according to claim 1, in which said pin of each carrier link has a conical end.

4. A device for driving shuttles according to claim 1, in which said chain guide means comprises a first portion for guiding each carrier link when in the engagement position and a second portion for guiding each carrier link when not in the engagement position, the first and second portions being parallel to said carriage guide means and being interconnected by intermediate inclined portions.

5. A device for driving shuttles according to claim 4, in which said chain guide means and said carriage guide means are provided within a fixed guide of said device.

6. A device for driving shuttles according to claim 5, in which said chain guide means are positioned within a pair of oppositely facing longitudinally-extending projections disposed on opposite internal walls of said fixed guide, which projections engage said links.

7. A device for driving shuttles according to claim 5, in which said carriage guide means is positioned within a longitudinally-extending groove in fixed guide and each carriage is provided with at least one roller which is adapted to be received in the groove.

8. A device for driving shuttles according to claim 1, in which each carriage is connected to its carrier link by a pin on said carrier link which engages a slot in said carriage.

9. A device for driving shuttles according to claim 8, in which said slot is curved.

* * * * *

UNITED STATES PATENT AND TRADEMARK OFFICE

CERTIFICATE OF CORRECTION

PATENT NO. : 4,071,054

DATED : January 31, 1978

INVENTOR(S) : Nicola Santucci, et al

It is certified that error appears in the above-identified patent and that said Letters Patent are hereby corrected as shown below:

Col. 1, line 10, after "links" insert a comma -- , --, and after "wherein" delete the comma " , ";

same line, after "are" insert -- arranged, --;

line 14, after "pins" insert -- hook-up --;

line 22, after "bobbins" insert -- and --;

UNITED STATES PATENT AND TRADEMARK OFFICE

CERTIFICATE OF CORRECTION

PATENT NO. : 4,071,054

DATED : January 31, 1978

INVENTOR(S) : Nicola Santucci, et al

It is certified that error appears in the above-identified patent and that said Letters Patent are hereby corrected as shown below:

Col. 1, line 35, after "device" delete "having" and insert -- comprising --;

line 36, delete " , comprising" and insert -- having --;

line 49, correct "embodiments" to read -- embodiment--;

lines 50-51, correct "position" to read -- portion --;

line 60, delete "the patent hinted at above" and substitute therefor -- the device --;

line 68, correct "device" to read -- devices --.

UNITED STATES PATENT AND TRADEMARK OFFICE

CERTIFICATE OF CORRECTION

PATENT NO. : 4,071,054

DATED : January 31, 1978

INVENTOR(S) : Nicola Santucci, et al

It is certified that error appears in the above-identified patent and that said Letters Patent are hereby corrected as shown below:

Col. 3, line 4, after "chain" insert the numeral -- 1 --;

line 15, before "The" (first occurrence) insert

-- Over --, and correct "The" to read --the--;

line 56, correct the spelling of "progress".

Signed and Sealed this

*Thirty-first* Day of *July 1979*

[SEAL]

*Attest:*

*Attesting Officer*

LUTRELLE F. PARKER

*Acting Commissioner of Patents and Trademarks*